US006533865B1

(12) United States Patent
Phan et al.

(10) Patent No.: US 6,533,865 B1
(45) Date of Patent: Mar. 18, 2003

(54) ACOUSTIC/ULTRASONIC AGITATION TO REDUCE MICROBUBBLES IN DEVELOPER

(75) Inventors: Khoi A. Phan, San Jose, CA (US); Bharath Rangarajan, Santa Clara, CA (US)

(73) Assignee: Advanced Micro Devices, Inc., Sunnyvale, CA (US)

( * ) Notice: Subject to any disclaimer, the term of this patent is extended or adjusted under 35 U.S.C. 154(b) by 0 days.

(21) Appl. No.: 09/521,034

(22) Filed: Mar. 8, 2000

(51) Int. Cl.[7] ..... G03D 3/02
(52) U.S. Cl. ..... 118/708
(58) Field of Search ..... 118/708

(56) References Cited

U.S. PATENT DOCUMENTS

| | | | | |
|---|---|---|---|---|
| 5,455,894 | A | | 10/1995 | Conboy et al. |
| 5,555,234 | A | | 9/1996 | Sugimoto |
| 5,625,433 | A | | 4/1997 | Inada et al. |
| 5,858,475 | A | * | 1/1999 | Chiu |
| 5,876,875 | A | * | 3/1999 | Chiu |
| 5,962,070 | A | | 10/1999 | Mitsuhashi et al. |
| 5,984,540 | A | | 11/1999 | Mimasaka et al. |
| 6,010,255 | A | * | 1/2000 | Chiu |

OTHER PUBLICATIONS

"Wafer Defect Reduction, Unpatterned Wafer Inspection, Surfscan®SP1", Copyright © 2000 KLA–Tencor Corporation. Taken from web site *http://www.kla–tencor.com/product/w–unpatterned.html* on Jan. 18, 2000, one page.

* cited by examiner

*Primary Examiner*—Olik Chaudhuri
*Assistant Examiner*—Joannie Adelle Garcia
(74) *Attorney, Agent, or Firm*—Eschweiler & Associates, LLC

(57) ABSTRACT

The present invention relates to a method of eliminating microbubbles associated with a developer solution. The method includes depositing the developer solution over an exposed photoresist film which overlies a substrate and agitating the developer solution using waves. The agitation of the developer solution causes the microbubbles to exit the developer solution and reduces defects previously associated therewith. In addition, a system for eliminating microbubbles associated with a developer solution is disclosed. The system includes an apparatus for applying the developer solution to a photoresist film which overlies a substrate and a developer agitation system. The developer agitation system is operably coupled to the developer solution and agitates the developer solution using waves, which causes the microbubbles to exit the developer solution.

11 Claims, 8 Drawing Sheets

ACOUSTIC/ULTRASONIC AGITATION TO REDUCE MICROBUBBLES IN DEVELOPER

FIELD OF THE INVENTION

The present invention relates generally to lithography and more particularly relates to a system and method for reducing microbubbles in a developer solution.

BACKGROUND OF THE INVENTION

Lithography in semiconductor processing relates generally to the process of transferring patterns which correspond to desired circuit components onto one or more thin films which overlie a substrate. One important step within the field of lithography involves optical tools and methods for transferring the patterns to the films which overlie the semiconductor wafer. Patterns are transferred to a film by imaging various circuit patterns onto a photoresist layer which overlies the film on the wafer. This imaging process is often referred to as "exposing" the photoresist layer. The benefit of the exposure process and subsequent processing allows for the generation of the desired patterns onto the film on the semiconductor wafer, as illustrated in prior art FIGS. 1*a*–1*f*.

Prior art FIG. 1*a* illustrates a photoresist layer 10 deposited by, for example, spin-coating, on a thin film 11 such as, for example, silicon dioxide ($SiO_2$) which overlies a substrate 12 such as silicon. The photoresist layer 10 is then selectively exposed to radiation 13 (e.g., ultraviolet (UV) light) via a photomask 14 (hereinafter referred to as a "mask") to generate one or more exposed regions 16 in the photoresist layer 10, as illustrated in prior art FIG. 1*b*. Depending on the type of photoresist material utilized for the photoresist layer 10, the exposed regions 16 become soluble or insoluble in a specific solvent which is subsequently applied across the wafer (this solvent is often referred to as a developer).

The exposed regions 16 are made either soluble or insoluble in the developer. When the exposed regions 16 are made soluble, a positive image of the mask 14 is produced in the photoresist layer 10, as illustrated in prior art FIG. 1*c*, and the photoresist material is therefore referred to as a "positive photoresist". The exposed underlying areas 18 in the film 11 may then be subjected to further processing (e.g., etching) to thereby transfer the desired pattern from the mask 14 to the film 11, as illustrated in prior art FIG. 1*d* (wherein the photoresist layer 10 has been removed). Conversely, when the exposed regions 16 are mode insoluble, a negative image of the mask 14 is produced in the photoresist 10 layer, as illustrated in prior art FIG. 1*e*, and the photoresist material is therefore referred to as a "negative photoresist". In a similar manner, the exposed underlying areas 20 in the film 11 may then be subjected to further processing (e.g., etching) to thereby transfer the desired pattern from the mask 14 to the film 11, as illustrated in prior art FIG. 1*f*.

The photoresist is formed typically on the wafer using a process called spin coating. Similarly, the developer material is also spin coated onto the wafer by applying developer material across the photoresist and then spin coating the developer material until centrifugal forces disperse the developer material over the coating of resist. A prior art developer nozzle system is illustrated in prior art FIG. 2. A developer nozzle 40 applies a developer solution or material 46 on a photoresist layer 48 disposed on a wafer 50. The wafer 50 is vacuum held onto a rotating chuck 52 driven by a shaft 54 which is coupled to a motor 56. The developer material 46 flows outward from the center of the photoresist material layer 48 covering the entire top surface thereof.

Due to the surface of the photoresist material layer on the semiconductor being highly hydrophobic, the photoresist surface can repel the developer material at the initial state of jetting out the developer material from the developer supply nozzle so that turbulent flow of the developer material is generated on the surface of the photoresist, resulting in the formation of microbubbles at the photoresist/developer interface, as illustrated in prior art FIG. 3. The microbubbles produced between the photoresist material layer and the developer material are a cause of defects in the resulting photoresist pattern.

A conventional solution to this problem has been to apply a washing solution material or liquid (e.g., water), that is typically used in a rinsing or washing process, onto the photoresist material layer and spin coat the washing solution material to form a washing solution material film. The developer material is then applied to the wafer and the spin coated thereon, and the washing solution material film is scattered off the surface of the photoresist material layer leaving only the developer material. Although the wetting step helps reduce the number of microbubbles at the photoresist/developer interface, it does not eliminate the problem. Consequently, as feature sizes continue to shrink, resist defects will to continue to adversely impact lithography performance.

SUMMARY OF THE INVENTION

The present invention relates to a system and method of improving lithography performance by eliminating microbubbles associated with a developer solution.

According to one aspect of the present invention, a system and method of eliminating microbubbles in a developer solution is disclosed. Microbubbles associated with the developer solution are eliminated by agitating the developer solution which overlies the exposed photoresist with waves, such as acoustic waves or ultrasonic waves. The waves break the microbubbles from the photoresist/developer interface and cause the microbubbles to move through and exit from a surface of the developer. Elimination of the microbubbles results in reduced defects in the resulting patterned photoresist, thereby improving subsequent patterning utilizing the patterned photoresist.

According to another aspect of the present invention, a system and method of eliminating microbubbles includes one or more sensors for monitoring one or more parameters associated with the developer solution and the waves utilized for agitation. For example, a thermal sensor is used to monitor a temperature associated with the developer solution during agitation. The thermal sensor feeds back such thermal information to a control system which may use such feedback data to modify one or more control signals used to control various properties of the waves (e.g., magnitude, frequency, or direction). Alternatively, a wave sensor is used to monitor one or more properties associated with the waves being produced to agitate the developer solution. The wave sensor feeds back such wave data to a control system which may use such feedback data to modify one or more control signals used to control various properties of the waves. Consequently, the present invention contemplates a dynamic feedback feature which allows a modulated agitation of the developer solution to maximize the benefits associated therewith.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

DETAILED DESCRIPTION OF THE INVENTION

Figure 1A:
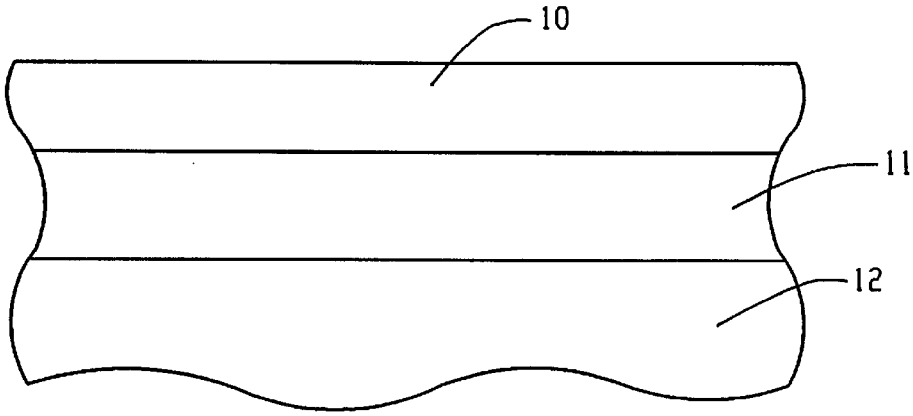
Fig. 1a (PRIOR ART)
FIG. 1*a* is a fragmentary cross section illustrating a prior art semiconductor substrate having a film overlying the substrate which in turn is covered by a photoresist layer.
Figure 1B:
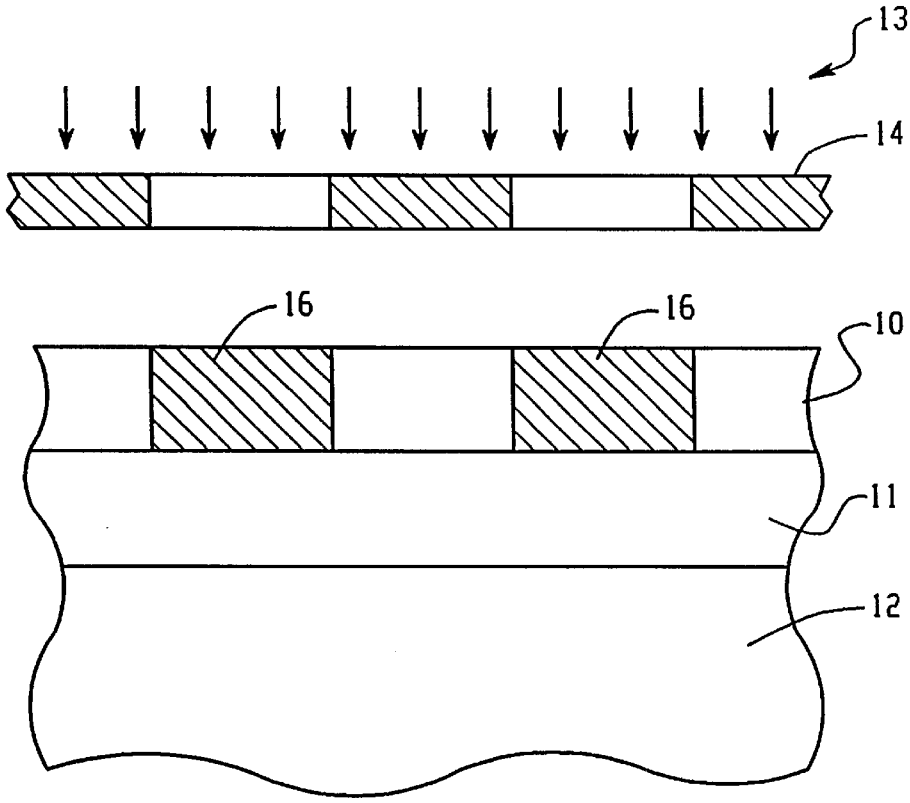
Fig. 1b (PRIOR ART)
FIG. 1*b* is a fragmentary cross section illustrating a prior art method of selectively exposing a photoresist layer using a mask.
Figure 1C:
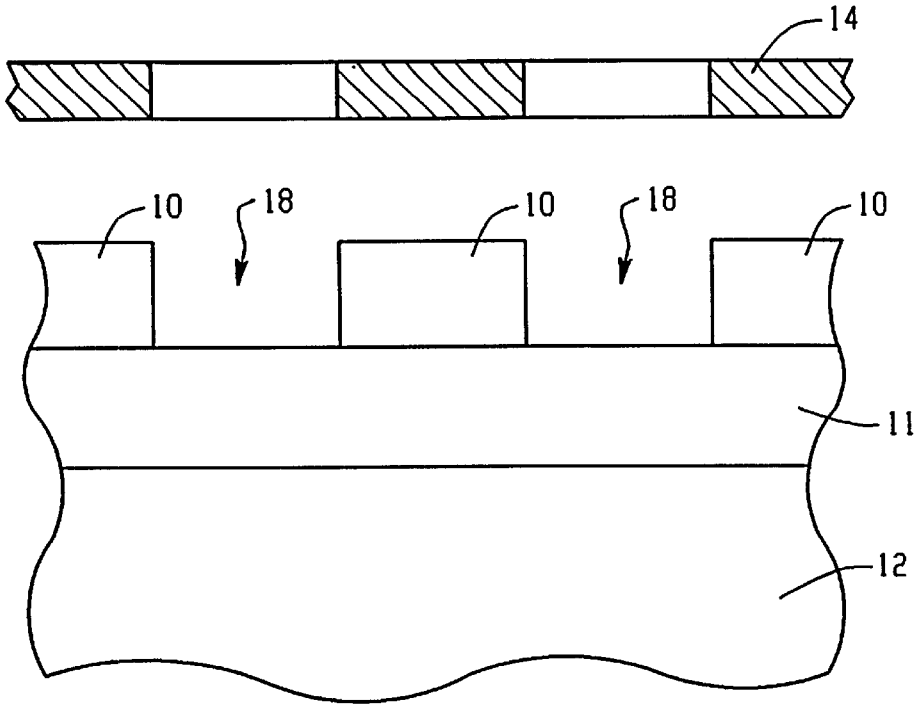
Fig. 1c (PRIOR ART)
FIG. 1*c* is a fragmentary cross section illustrating a positive photoresist layer after being developed.
Figure 1D:
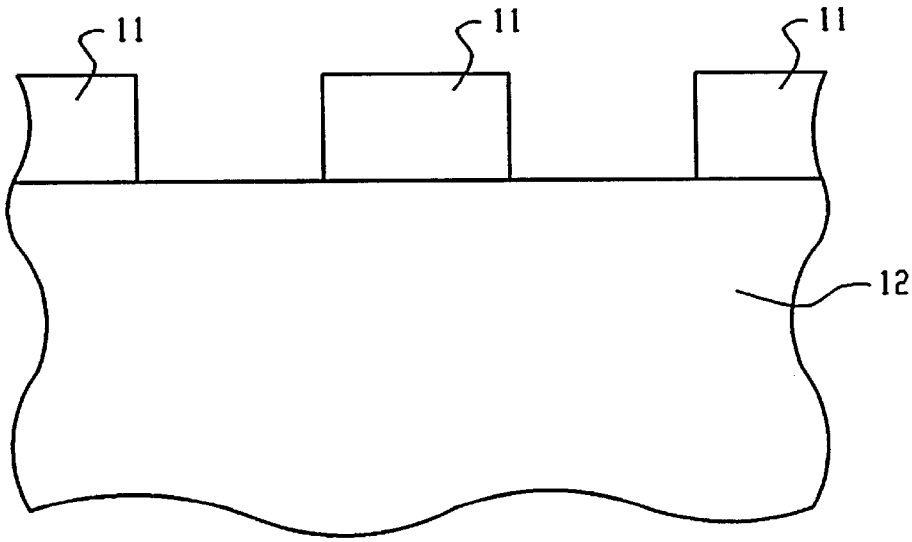
Fig. 1d (PRIOR ART)
FIG. 1*d* is a fragmentary cross section illustrating a transfer of a mask pattern to the film.
Figure 1E:
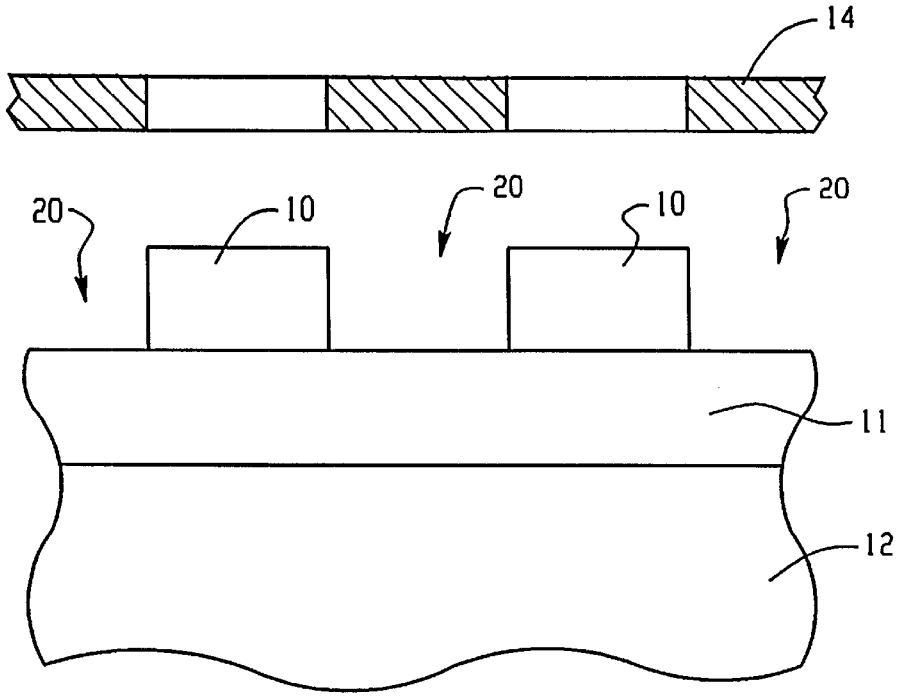
Fig. 1e (PRIOR ART)
FIG. 1*e* is a fragmentary cross section illustrating a negative photoresist layer after being developed.
Figure 1F:
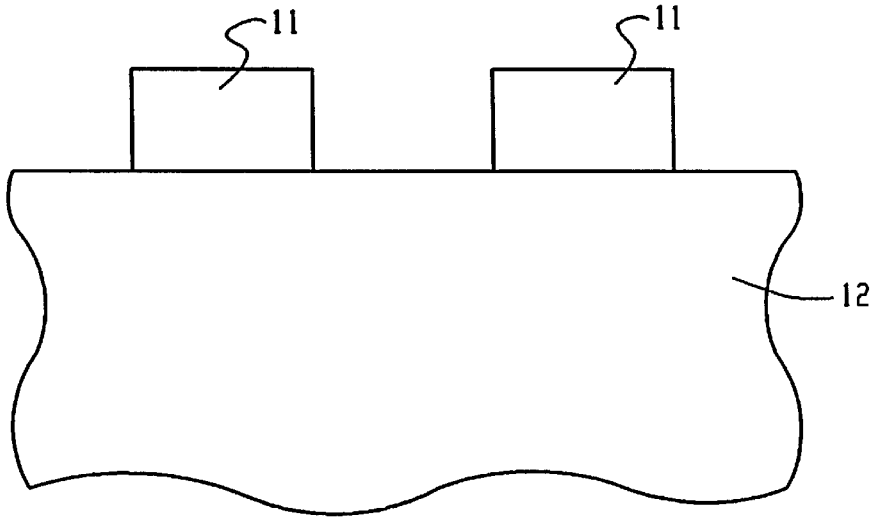
Fig. 1f (PRIOR ART)
FIG. 1*f* is a fragmentary cross section illustrating a transfer of a mask pattern to the film.
Figure 2:
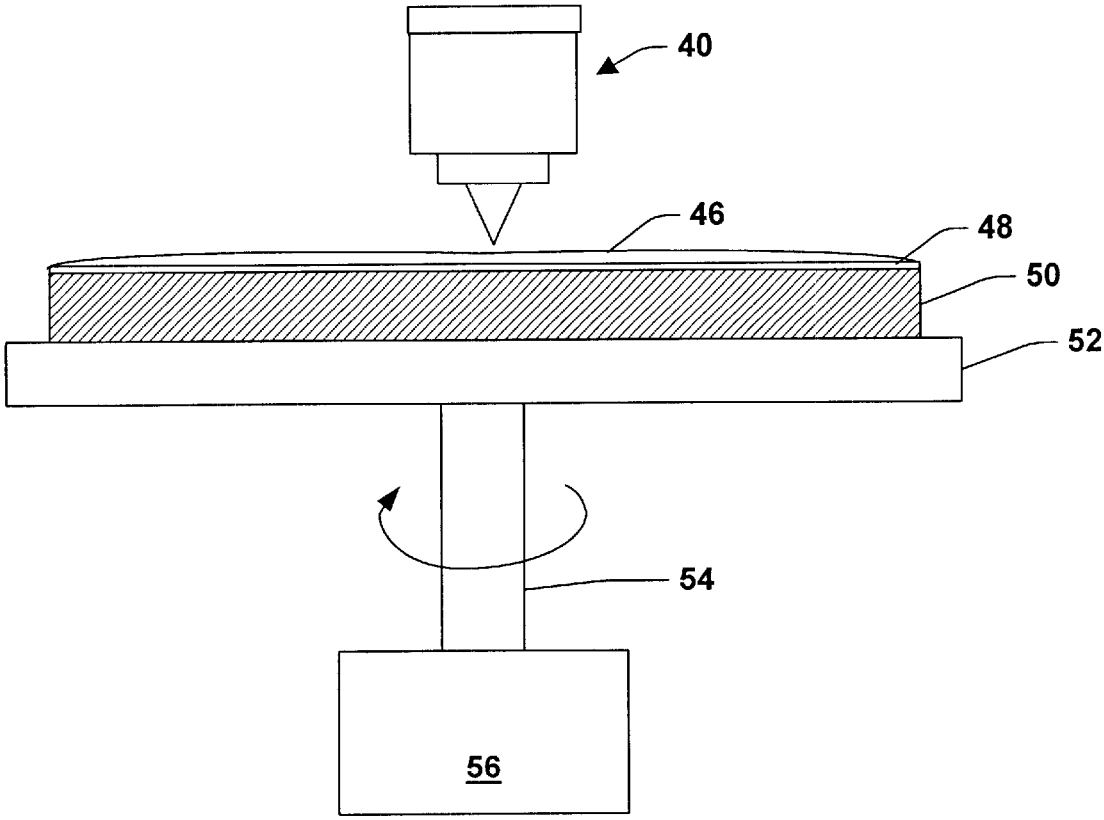
FIG. 2 (PRIOR ART)
FIG. 2 is a cross section diagram illustrating a prior art system for depositing and forming a developer solution film over an exposed photoresist layer.
Figure 3:
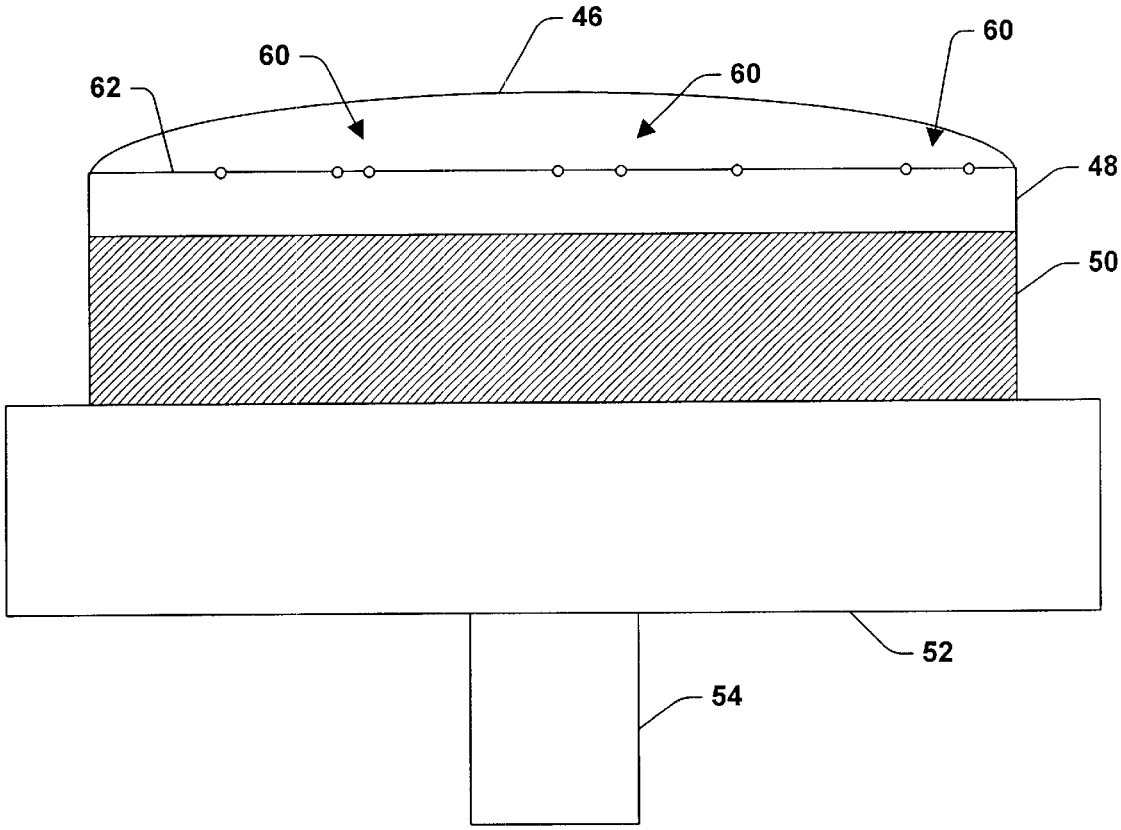
FIG. 3 (PRIOR ART)
FIG. 3 is a cross section diagram illustrating a plurality of exemplary microbubbles at the interface between the photoresist layer and the developer solution.

The following is a detailed description of the present invention made in conjunction with the attached Figures, wherein like reference numerals will refer to like elements throughout. The present invention relates to a system and method of eliminating microbubbles in a developer solution during lithography processing. The present invention utilizes waves such as acoustic waves or ultrasonic waves to agitate the developer solution overlying a selectively exposed photoresist film. The agitation causes the microbubbles to break away from the photoresist/developer interface and exit the developer solution from an exposed surface. In addition, one or more sensors or monitoring type devices may be employed to monitor one or more characteristics associated with either the developer or the waves during agitation, and such characteristics are used to dynamically adjust one or more agitation conditions in order to maximize the benefits associated therewith.

Figure 4:
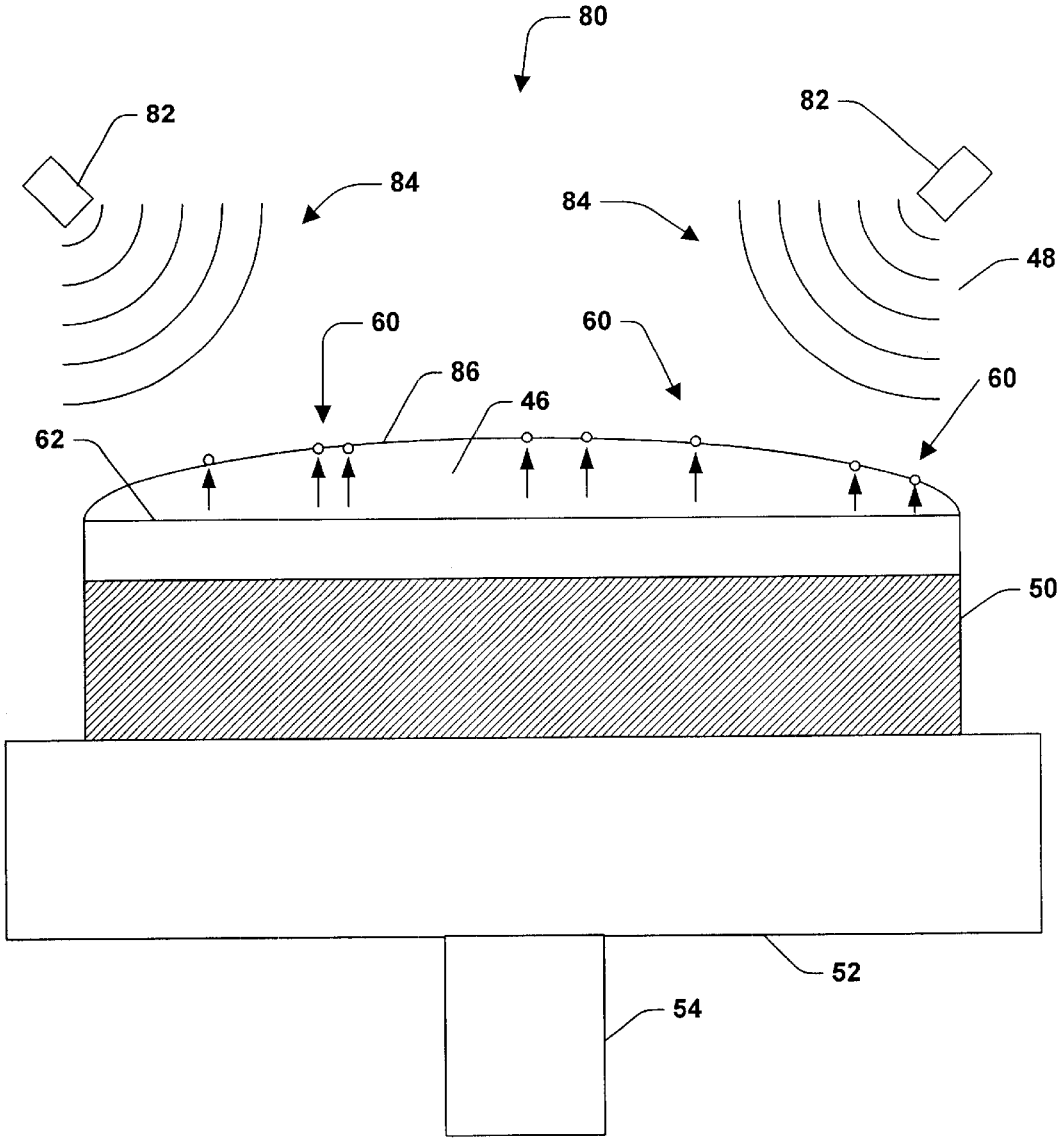
FIG. 4 is a cross section diagram illustrating an agitation of the developer solution using waves, and the movement of the microbubbles associated with the developer solution toward a surface thereof according to the present invention.

Turning now to the Figures, FIG. 4 is a cross section diagram of a system 80 for eliminating microbubbles associated with a developer solution. The system 80 includes at least one wave source 82 located near the developer solution 46. The wave source(s) 82 generate waves 84 which travel generally toward the developer solution 46. Upon the waves 84 impinging upon or otherwise contacting the developer 46, the developer 46 is agitated. That is, the waves 84 impart at least a portion of their associated energy to the developer solution 46, causing agitation on at least the microscopic level. The agitation causes the microbubbles 60 to break free from the photoresist/developer interface 62, travel through the developer 46, and exit at a surface 86 thereof.

Various types of waves 84 may be utilized and are contemplated as falling within the scope of the present invention. For example, the waves 84 may comprise acoustic waves or ultrasonic waves, as may be desired. Accordingly, the wave source 82 may vary depending upon the type of wave 84 being produced. In addition, the wave source 82 may be a variable source, for example, having a magnitude, frequency and/or direction that may be modified in either an analog or discrete manner, as may be desired. Therefore the one or more sources 82 may be tuned as a function of the developer type, or other process condition.

Figure 5:
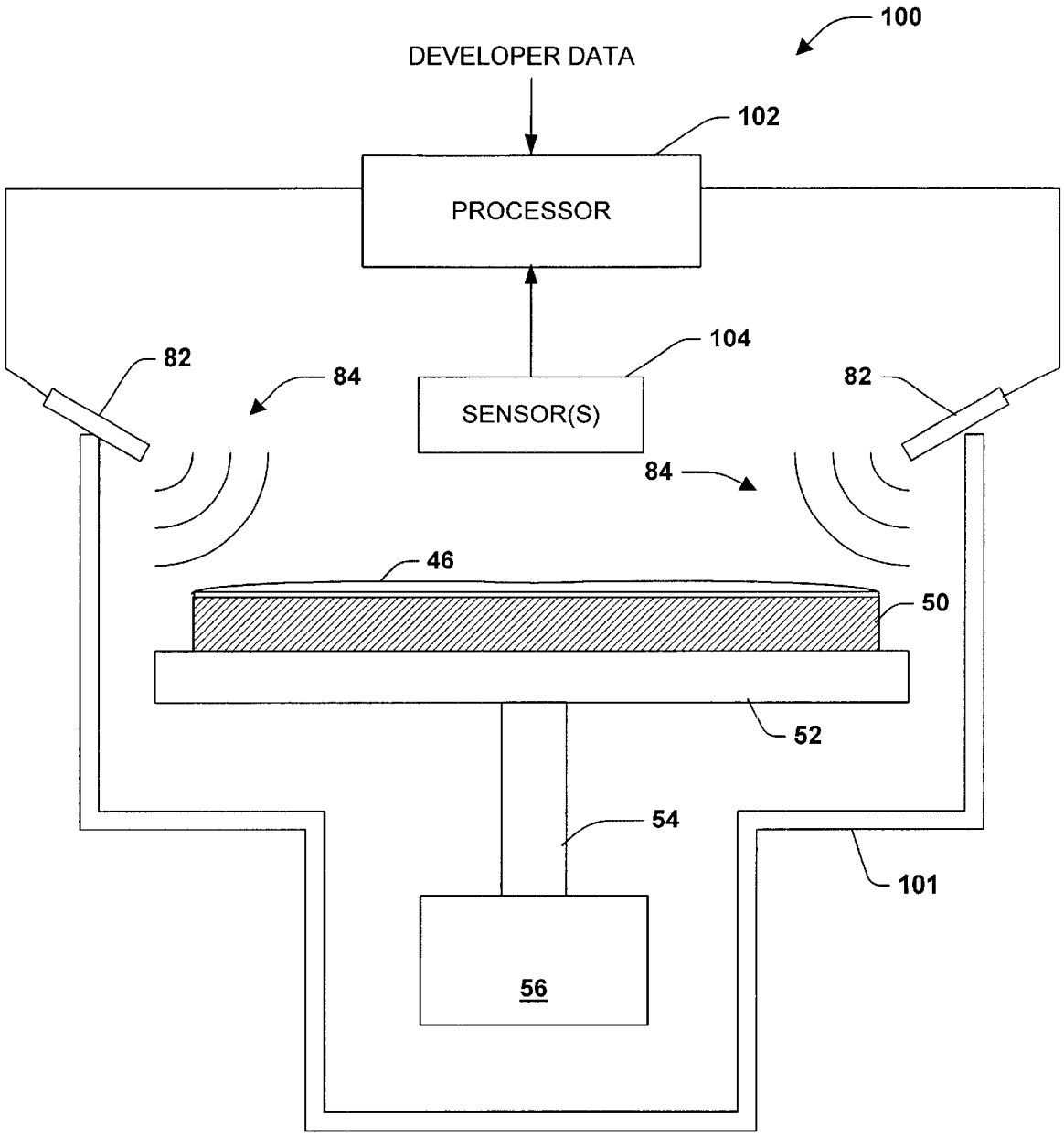
FIG. 5 is a cross section diagram illustrating a system for agitating the developer solution in order to eliminate microbubbles associated therewith, and a monitoring system for providing feedback according to the present invention.

FIG. 5 is another exemplary system 100 for eliminating microbubbles in accordance with the present invention. The system 100 may include a developer cup 101 for housing the various components 46–56, respectively. In a manner similar to that of FIG. 4, the system 100 includes wave sources 82 which produce waves 84 for agitation of the developer 46 overlying the selectively exposed photoresist 48. The system 100 also includes a processor 102 which may be configured to operate as a control system therefore. The processor 102 is adapted to receive input data, such as developer characterization data or other data relating to the developer solution, and generate one or more control signals used for driving the one or more waves sources 82, respectively.

The system 100 of FIG. 5 also may include one or more sensors 104 for monitoring one or more characteristics associated with the developer 46 undergoing agitation. Because developer temperature, in some cases, is a critical process parameter and may impact feature uniformity and/or process control, the thermal sensor monitors the temperature associated therewith, and communicates such data (in either digital or analog form, as may be desired) to the processor 102, which is configured to take such thermal data and either generate or modify one or more control signals to effectively modulate the wave sources 82 in response thereto. For example, if the thermal data identified by the sensor 104 indicates the developer temperature is exceeding an acceptable threshold or is increasing above a predetermined rate, the processor 102 may, using one or more control signals, modify a magnitude, frequency and/or direction of the waves 84 produced by the waves sources 82.

Although temperature is one variable that may be monitored, other system parameters may also be monitored and used to provide dynamic feedback, and any such monitoring is contemplated as falling within the scope of the present invention. For example, instead of monitoring a parameter(s) associated with the developer 46, one may instead monitor the waves 84 themselves. That is, the sensor 104 may be operable to sense/detect a characteristic associated with the waves 84 that are producing the agitation within the developer 46. For example, the sensor 104 may be operable to detect one or more of a magnitude, frequency or direction of the waves 84. Therefore if the detected magnitude is outside an acceptable range, for example, the processor 102 may generate or modify one or more control signals used to control the waves sources 82. Similarly, such feedback may be utilized in conjunction with other parameters associated with the waves 84, as may be desired.

Figure 6:
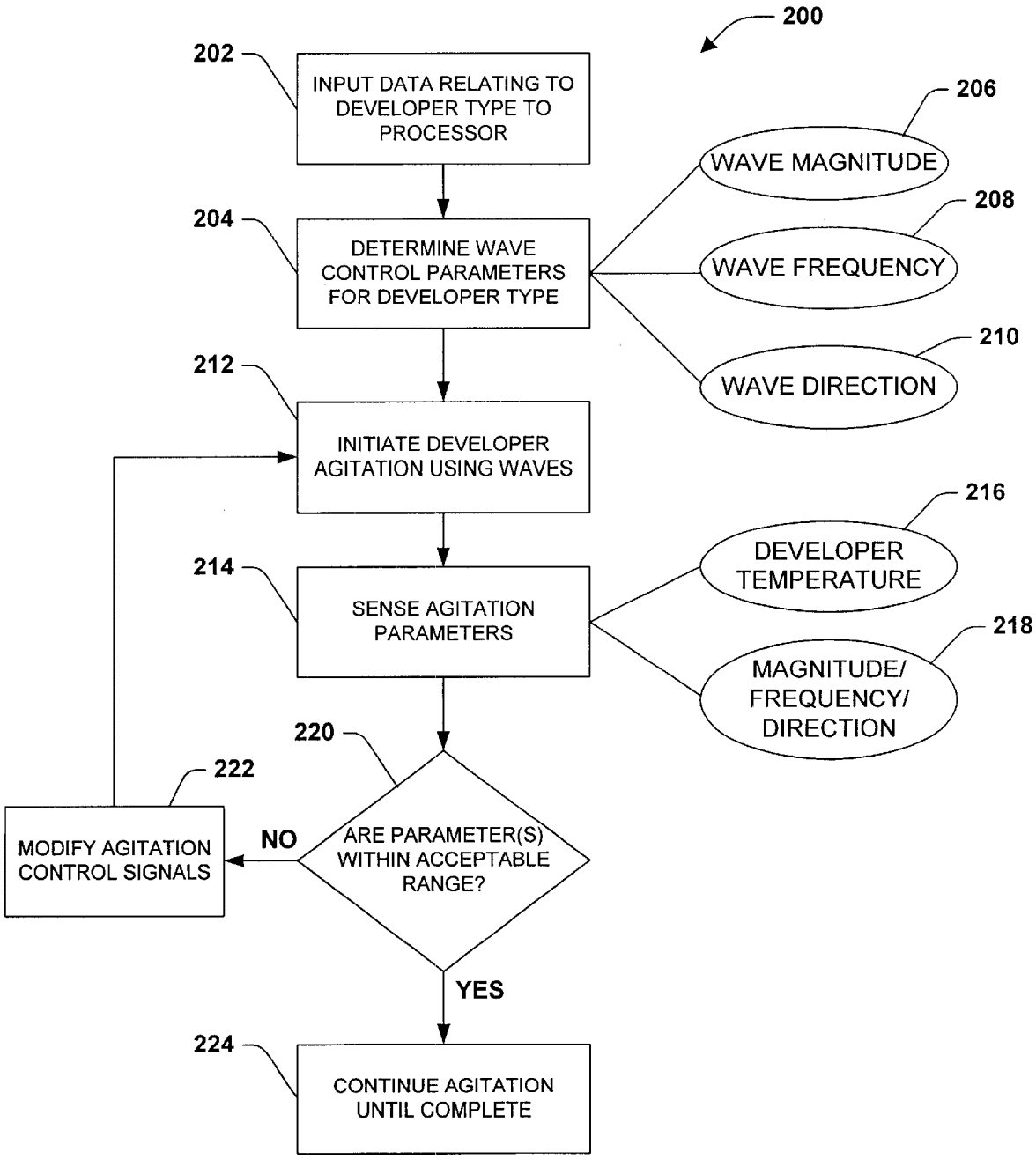
FIG. 6 is a flow chart illustrating a method of eliminating microbubbles associated with a developer solution in lithography processing according to the present invention.

According to another aspect of the present invention, a method of eliminating microbubbles associated with a developer solution is illustrated in FIG. 6, and designated at reference numeral 200. According to the above exemplary method 200, input data relating to the type of developer solution being used to develop the photoresist is input to a processor such as the processor 102 of FIG. 5 at step 202. Such input data may include, for example, the developer trade name, or chemical name, or may include one or more pieces of information which identify or otherwise characterize the developer solution. In addition, other developer data may be used and is contemplated as falling within the scope of the present invention.

The processor 102 then determines one or more wave control parameters in response to the developer input data and generates one or more control signals associated therewith at step 204. Such control signals may be operable to control one or more waves sources 82 to control one or more of a wave magnitude 206, a wave frequency 208 and/or a wave direction 210, respectively. Alternatively, the control signals may be used to provide other types of control, for example, a duty cycle, etc. Any manner of wave control may be effectuated and is contemplated as falling within the scope of the present invention. The control signals generated by the processor 102 are then transmitted to the one or more wave sources 82 and used to initiate agitation of the developer solution as the solution overlies a selectively exposed photoresist layer at step 212.

The method 200 continues at step 214 by sensing or otherwise monitoring one or more agitation parameters using, for example, the one or more sensors 104, as illustrated in FIG. 5. Such agitation parameters may include, for example the temperature of the developer 216 during the agitation, or a parameter 218 associated with the waves 84 being used for agitation, for example, a wave magnitude, frequency and/or direction. Other types of agitation parameters may also be used and any such characteristic associated therewith is contemplated as falling within the scope of the present invention.

Once the one or more parameters are detected at step 214, such data is evaluated using, for example, the processor 102, to determine whether such detected parameters(s) are within an acceptable range at step 220. Step 220 may include, for example, comparing a detected developer temperature to one or more predetermined or dynamically adjustable temperature thresholds or comparing a detected wave magnitude or frequency to one or more such thresholds. If such detected parameters are not at an acceptable amount (NO), the control signals used to generate the waves 84 are modified to provide a dynamic feedback at step 222. For example, the processor 102 may modify such control signals according to its internal programming, according to a set of expert rules or fuzzy logic, using a neural network, etc. Any manner of providing a feedback and dynamic control associated therewith may be used and is contemplated as falling within the scope of the present invention. Alternatively, if at step 220 it is determined that the detected data is at an acceptable value (YES), the developer agitation continues at its present state until development of the exposed photoresist is complete at step 224.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described components (assemblies, devices, circuits, etc.), the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more other features of the other embodiments as may be desired and advantageous for any given or particular application. Furthermore, to the extent that the term "includes" is used in either the detailed description and the claims, such term is intended to be inclusive in a manner similar to the term "comprising."

What is claimed is:

1. A method of eliminating microbubbles associated with a developer solution, comprising the steps of:

depositing the developer solution over an exposed photoresist film which overlies a substrate;

after depositing the developer solution, agitating the developer solution using waves, wherein the agitation causes the microbubbles to exit the developer solution; and wherein agitating the developer solution using waves further comprises tuning one or more of a magnitude, direction and frequency of the waves as a function of one or more properties of the developer solution or the photoresist film.

2. A method of eliminating microbubbles associated with a developer solution, comprising the steps of:

depositing the developer solution over an exposed photoresist film which overlies a substrate;

agitating the developer solution using waves, wherein the agitation causes the microbubbles to exit the developer solution;

monitoring one or more parameters associated with the developer solution while the developer solution is being agitated; and using the one or more parameters to vary a magnitude, frequency or direction of the waves.

3. The method of claim 2, wherein a monitored parameter associated with the developer solution comprises a temperature thereof.

4. The method of claim 2, wherein monitoring the one or more parameters comprises:

measuring the one or more parameters associated with the developer solution;

comparing at least one of the measured one or more parameters to at least one or more thresholds or acceptable ranges; and modifying agitation control signals in response to the comparison.

5. A method of eliminating microbubbles associated with a developer solution, comprising the steps of:

depositing the developer solution over an exposed photoresist film which overlies a substrate;

agitating the developer solution using waves, wherein the agitation causes the microbubbles to exit the developer solution;

monitoring one or more parameters associated with the waves used to agitate the developer solution; and using the one or more parameters to vary a magnitude, frequency or direction of the waves.

6. A method of eliminating microbubbles associated with a developer solution, comprising the steps of:

depositing the developer solution over an exposed photoresist film which overlies a substrate;

agitating the developer solution using waves, wherein the agitation causes the microbubbles to exit the developer solution;

identifying data characterizing the developer solution; and using the characterization data to determine an initial magnitude, frequency or direction of the waves used for agitating the developer solution.

7. The method of claim 5, further comprising inputting input data relating to a type of the developer solution and determining one or more wave control parameters in response to the input data prior to agitating the developer solution.

8. The method of claim 7, wherein the input data includes at least one item from the group comprising a developer trade name and a chemical name.

9. The method of claim 5, wherein agitating the developer solution comprises exposing the developer solution to acoustic sound waves, wherein the acoustic sound waves cause the microbubbles to break away from an interface between the photoresist film and the developer solution, move through the developer solution, and exit therefrom via an exposed surface.

10. The method of claim 5, wherein agitating the developer solution comprises exposing the developer solution to ultrasonic sound waves, wherein the ultrasonic sound waves cause the microbubbles to break away from an interface between the photoresist film and the developer solution, move through the developer solution, and exit therefrom via an exposed surface.

11. The method of claim 5, wherein agitating the developer solution using waves further comprises tuning one or more of a magnitude, direction and frequency of the waves as a function of one or more properties of the developer solution or the photoresist film.

* * * * *